US005826226A

United States Patent [19]

Ozawa

[11] Patent Number: 5,826,226

[45] Date of Patent: Oct. 20, 1998

[54] SPEECH CODING APPARATUS HAVING AMPLITUDE INFORMATION SET TO CORRESPOND WITH POSITION INFORMATION

[75] Inventor: Kazunori Ozawa, Tokyo, Japan

[73] Assignee: NEC Corporation, Tokyo, Japan

[21] Appl. No.: 722,635

[22] Filed: Sep. 27, 1996

[30] Foreign Application Priority Data

Sep. 27, 1995 [JP] Japan ..... 7-249889

[51] Int. Cl.[6] ..... G10L 5/00

[52] U.S. Cl. ..... 704/223; 704/219; 704/222

[58] Field of Search ..... 704/223, 222, 704/220, 219

[56] References Cited

U.S. PATENT DOCUMENTS

| | | | |
|---|---|---|---|
| 4,932,061 | 6/1990 | Kroon et al. | 704/223 |
| 4,945,565 | 7/1990 | Ozawa et al. | 704/223 |
| 4,945,567 | 7/1990 | Ozawa | 704/223 |
| 4,991,214 | 2/1991 | Freemen et al. | 704/223 |
| 5,027,405 | 6/1991 | Ozawa | 704/223 |
| 5,142,584 | 8/1992 | Ozawa | 704/223 |
| 5,602,961 | 2/1997 | Kolesnik et al. | 704/223 |
| 5,633,980 | 5/1997 | Ozawa | 704/223 |
| 5,642,465 | 6/1997 | Scott et al. | 704/223 |

FOREIGN PATENT DOCUMENTS

| | | |
|---|---|---|
| 4-171500 | 6/1992 | Japan . |
| 4-363000 | 12/1992 | Japan . |
| 5-6199 | 1/1993 | Japan . |
| 6-222797 | 8/1994 | Japan . |

OTHER PUBLICATIONS

"Code–Excited Linear Prediction (CELP): High Quality at Very Low Bit Rates", M. Schroeder and B. Atal et al., Proc. ICASSP, 1985, pp. 937–940.

"Improved Speech Quality and Efficient Vector Quantization in SELP", Kleijn et al., Proc. ICASSP, 1988, pp. 155–158.

"16 KBPS Wideband Speech Coding Technique Based on Algebraic CELP", C. Laflamme et al., Proc. ICASSP, 1991, pp. 13–16.

"Signal Analysis and System Identification", T. Nakamizo, Corona, 1988, pp. 82–87.

"Speech Data Compression by LSP Speech Analysis–Synthesis Technique", N. Sogamura et al., Journal of the Electronic Communications Society of Japan, J64–A, 1981, pp. 559–606.

"LSP Coding VQ–SVQ with Interpolation in 4.075 KBPS M–LCELP Speech Coder", T. Nomura et al., Proc. Mobile Multimedia Communications, 1993, pp. B.2.5.

"Pitch Predictors with High Terminal Resolution", P. Kroon, Proc. ICASSP, 1990, pp. 661–664.

"A Study on Pulse Search Algorithms for Multipulse Excited Speech Coder Realization", K. Ozawa et al., IEEE Journal on Selected Areas in Communications, vol. sac–4, No. 1, Jan. 1996, pp. 133–141.

"An Algorithm for Vector Quantization Design", Linde et al., IEEE Trans. Commun., Jan. 1980, pp. 84–95.

*Primary Examiner*—David R. Hudspeth
*Assistant Examiner*—Susan Wieland
*Attorney, Agent, or Firm*—Foley & Lardner

[57] ABSTRACT

The invention provides a speech coding apparatus by which a good sound quality can be obtained even when the bit rate is low. The speech coding apparatus includes an excitation quantization circuit which quantizes an excitation signal using a plurality of pulses. The position of at least one of the pulses is represented by a number of bits determined in advance, and the amplitude of the pulse is determined in advance depending upon the position of the pulse.

20 Claims, 13 Drawing Sheets

SPEECH CODING APPARATUS HAVING AMPLITUDE INFORMATION SET TO CORRESPOND WITH POSITION INFORMATION

BACKGROUND OF THE INVENTION

1. Field of the Invention

This invention relates to a speech coding apparatus, and more particularly to a speech coding apparatus which codes a speech signal at a low bit rate with high quality.

2. Description of the Related Art

Various methods which code a speech signal with high efficiency are already known, and a representative one of the known methods is CELP (Code Excited Linear Predictive Coding) disclosed, for example, in M. Schroeder and B. Atal, "Code-excited linear prediction: High quality speech at low bit rates", Proc. ICASSP, 1985, pp.937–940 (hereinafter referred to as document 1) or Kleijn et al., "Improved speech quality and efficient vector quantization in SELP", Proc. ICASSP, 1988, pp.155–158 (hereinafter referred to as document 2). In those prior art methods, on the transmission side, spectrum parameters representative of a spectrum characteristic of a speech signal are extracted from the speech signal for each frame (for example, 20 ms) using a linear predictive (LPC) analysis. Each frame is divided into subframes (for example, of 5 ms), and for each subframe, parameters for an adaptive codebook (a delay parameter and a gain parameter corresponding to a pitch period) are extracted based on the excitation signal in the past and then the speech signal of the subframe is pitch predicted using the adaptive codebook. Then, based on a residue signal obtained by the pitch prediction, an optimum excitation code vector is selected from within an excitation codebook (vector quantization codebook) which includes predetermined kinds of noise signals, and an optimum gain is calculated to quantize the excitation signal. The selection of an excitation code vector is performed so as to minimize an error power between a signal synthesized based on the selected noise signal and the residue signal. Then, an index and a gain representative of the kind of the selected code vector as well as the spectrum parameter and the parameters of the adaptive codebook are combined and transmitted by a multiplexer section. Description of operation of the reception side is omitted herein.

The prior art coding described above is disadvantageous in that a large quantity of calculation is required for selection of an optimum excitation code vector from within an excitation codebook. This arises from the fact that, with the coding methods of the documents 1 and 2, in order to select an excitation code vector, filtering or convolution calculation is performed once for code vectors, and such calculation is repeated by a number of times equal to the number of code vectors stored in the codebook. For example, when the bit number of the codebook is B and the number of elements is N, if the filter or impulse response length upon filtering or convolution calculation is K, then the quantity of calculation required is $N \times K \times 2^B \times 8{,}000/N$ per one second. As an example, where B=10, N=40 and k=10, 81,920,000 calculations are required. In this manner, the prior art coding is disadvantageous in that a very large quantity of calculations is required.

Various methods which achieve remarkable reduction in calculation quantity required for searching an excitation codebook have been disclosed. One of the methods is an ACELP (Algebraic Code Excited Linear Prediction) method, which is disclosed, for example, in C. Laflamme et al., "16 kbps wideband speech coding technique based on algebraic CELP", Proc. ICASSP, 1991, pp.13–16 (hereinafter referred to as document 3). According to the method disclosed in the document 3, an excitation signal is represented by and transmitted as a plurality of pulses whose positions are represented by predetermined bit numbers. Here, since the amplitude of each pulse is limited to +1.0 or −1.0, no amplitude need be transmitted except the polarity of each pulse. The polarity of each pulse is determined one by one from the speech signal and fixed before searching for pulse positions. Consequently, the calculation quantity for searching of pulses can be reduced remarkably.

Further, while the method of the document 3 can reduce the calculation quantity remarkably, it is disadvantageous in that it does not provide a sufficiently high speech quality. The reason is that, since each pulse only has the polarity of positive or negative and its absolute amplitude is always 1.0 irrespective of the position of the pulse, the amplitudes of the pulses are quantized but very roughly, resulting in low speech quality.

SUMMARY OF THE INVENTION

It is an object of the present invention to provide a speech coding apparatus which can code a speech signal with a comparatively small quantity of calculation and does not suffer from much deterioration in picture quality even when the bit rate is low.

In order to attain the object described above, according to an aspect of the present invention, there is provided a speech coding apparatus for calculating a spectral parameter from a speech signal inputted thereto, quantizing an excitation signal of the speech signal using the spectral parameter and outputting the quantized excitation signal, the apparatus comprising an excitation quantization section for quantizing the excitation signal using a plurality of pulses such that a position of at least one of the pulses is represented by a number of bits determined in advance and an amplitude of the pulse is determined in advance depending upon the position of the pulse.

In the speech coding apparatus, when the excitation quantization section forms M pulses for each fixed interval of time to quantize an excitation signal, where the amplitude and the position of the ith pulse are represented by $g_i$ and $m_i$, respectively, the excitation signal can be represented by the following equation (1):

$$v(n) = G \sum_{i=1}^{M} g_i \delta(n - m_i) \tag{1}$$

where G is the gain representative of the entire level. For at least one pulse, for example, for two pulses, an amplitude value is determined in advance for each of combinations of the positions of them depending upon the positions of the pulses.

Preferably, the position which can be assumed by each pulse is limited in advance. The position of each pulse may be, for example, an even-numbered sample position, an odd-numbered sample position or every Lth sample position.

According to another aspect of the present invention, there is provided a speech coding apparatus for calculating a spectral parameter from a speech signal inputted thereto, quantizing an excitation signal of the speech signal using the spectral parameter and outputting the quantized excitation signal, the apparatus comprising an excitation quantization section for quantizing the excitation signal using a plurality of pulses such that a position of at least one of the pulses is represented by a number of bits determined in advance and amplitudes of the plurality of pulses are quantized simultaneously.

In the speech coding apparatus, amplitude patterns representative of amplitudes of a plurality of pulses (for example, 2 pulses) for B bits ($2^B$ amplitude patterns) in the equation (1) above are prepared as an amplitude codebook in advance, and an optimum amplitude pattern is selected from among the amplitude patterns. Also with the present speech coding apparatus, preferably the position which can be assumed by each pulse is limited in advance.

According to a further aspect of the present invention, there is a speech coding apparatus for calculating a spectral parameter from a speech signal inputted thereto, quantizing an excitation signal of the speech signal using the spectral parameter and outputting the quantized excitation signal, the apparatus comprising a mode discrimination section for discriminating a mode from the speech signal inputted thereto and outputting discrimination information, and an excitation quantization section for quantizing the excitation signal using a plurality of pulses when the discrimination information from the mode discrimination section represents a specific mode such that a position of at least one of the pulses is represented by a number of bits determined in advance and an amplitude of the pulse is determined in advance depending upon the position of the pulse.

In the speech coding apparatus, an input signal is divided into frames, and a mode is discriminated for each frame using a characteristic amount. For example, four modes of 0 to 3 may be used. The modes generally correspond to the following portions of the speech signal. In particular, mode 0: a silent/consonant portion, mode 1: a transition portion, mode 2: a weak steady portion of a vowel, and mode 3: a strong steady portion of a vowel. Then, when a frame is in a predetermined mode, for at least one pulse, for example, for two pulses, an amplitude value is determined for each of combinations of positions of them depending upon the positions of the pulses.

According to a still further aspect of the present invention, there is provided a speech coding apparatus for calculating a spectral parameter from a speech signal inputted thereto, quantizing an excitation signal of the speech signal using the spectral parameter and outputting the quantized excitation signal, the apparatus comprising a mode discrimination section for discriminating a mode from the speech signal inputted thereto and outputting discrimination information, and an excitation quantization section for quantizing the excitation signal using a plurality of pulses when the discrimination information from the mode discrimination section represents a specific mode such that a position of at least one of the pulses is represented by a number of bits determined in advance and amplitudes of the plurality of pulses are quantized simultaneously.

In the speech coding apparatus, an input signal is divided into frames, and a mode is discriminated for each frame using a characteristic amount. Then, when a frame is in a predetermined mode, amplitude patterns representative of amplitudes of a plurality of pulses (for example, 2 pulses) for B bits ($2^B$ amplitude patterns) are prepared as an amplitude codebook in advance, and an optimum amplitude pattern is selected from among the amplitude patterns.

In summary, with the speech coding apparatus of the present invention, since the excitation quantization section quantizes the excitation signal using a plurality of pulses such that a position of at least one of the pulses is represented by a number of bits determined in advance and an amplitude of the pulse is determined in advance depending upon the position of the pulse or the amplitude of the pulse is learned in advance using a speech signal depending upon the position of the pulse, the speech quality is improved comparing with that obtained by the conventional methods while reducing the amount of calculations for searching for an excitation pulse.

Further, with the speech coding apparatus, since it includes a codebook in order to quantize amplitudes of a plurality of pulses simultaneously, it is advantageous in that the speech quality is further improved relative to that obtained by the conventional methods while reducing the amount of calculations for searching for an excitation pulse.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
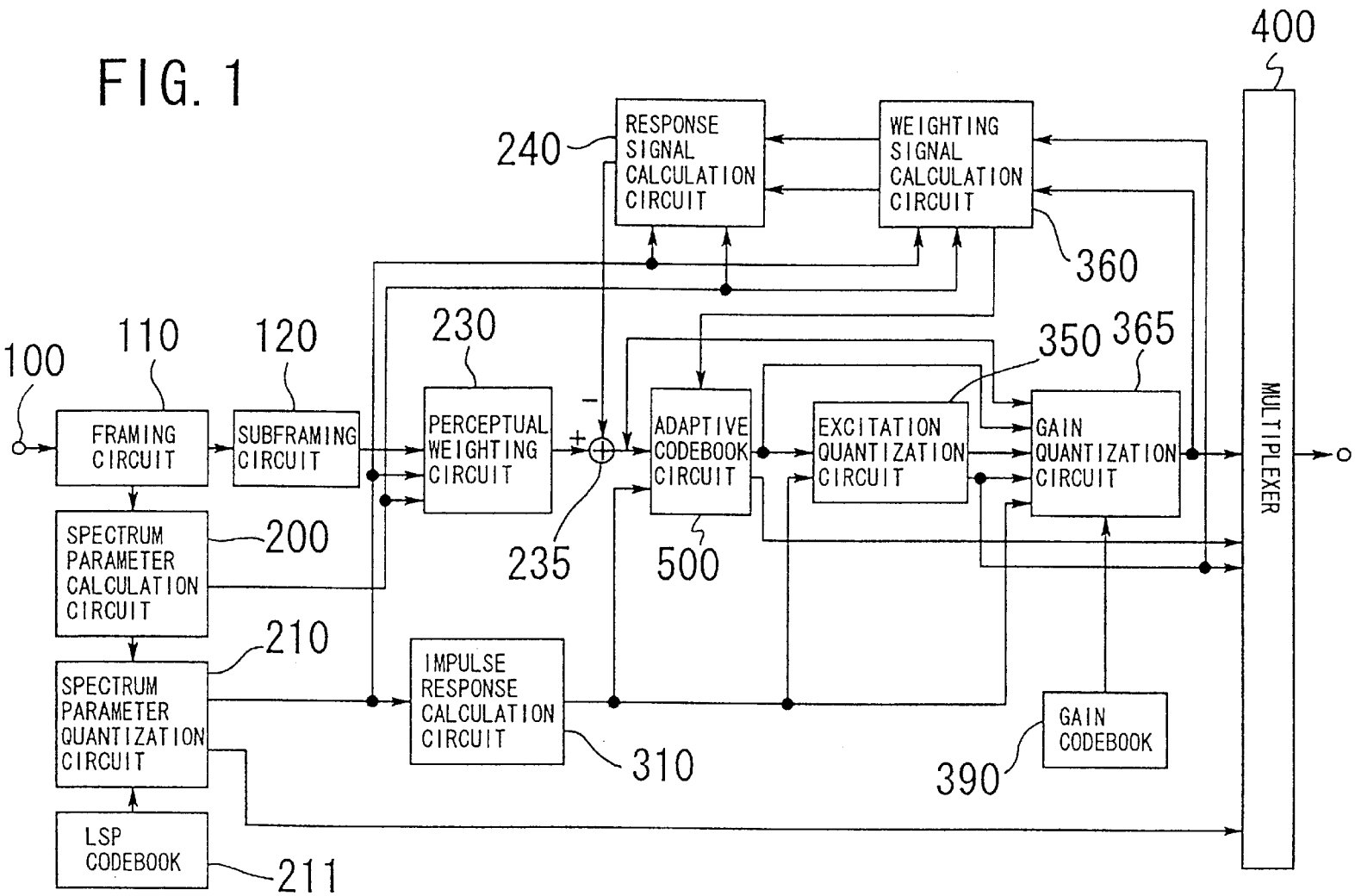
FIG. 1 is a block diagram of a speech coding apparatus showing a preferred embodiment of the present invention.

Referring to FIG. 1, there is shown in block diagram a speech coding apparatus according to a preferred embodiment of the present invention. The speech coding apparatus shown includes a framing circuit 110, a subframing circuit 120, a spectrum parameter calculation circuit 200, a spectrum parameter quantization circuit 210, an LSP codebook 211, a perceptual weighting circuit 230, a subtraction circuit 235, an adaptive codebook circuit 500, an excitation quantization circuit 350, a gain quantization circuit 365, a response signal calculation circuit 240, a weighting signal calculation circuit 360, an impulse response calculation circuit 310, a gain codebook 390 and a multiplexer 400.

When a speech signal is inputted from an input terminal 100, it is divided into frames (for example, of 10 ms) by the framing circuit 110 and is further divided into subframes (for example, of 2 ms) shorter than the frames by the subframing circuit 120.

The spectrum parameter calculation circuit 200 applies a window (for example, of 24 ms) longer than the subframe length to the speech signal of at least one subframe to cut out the speech signal and calculates a predetermined order number (for example, P=10 orders) of spectrum parameters. Here, for the calculation of spectrum parameters, an LPC analysis, a Burg analysis and so forth which are well known in the art can be used. Here, the Burg analysis is used. Details of the Burg analysis are disclosed, for example, in T. Nakamizo, "Signal Analysis and System Identification", Corona, 1988, pp.82–87 (hereinafter referred to as document 4), and since the Burg analysis is a known technique, description of it is omitted herein.

Further, the spectrum parameter calculation circuit 200 converts linear predictive coefficients $\alpha_i$ (i=1, . . . , 10) calculated using the Burg method into LSP parameters suitable for quantization and interpolation. Such conversion from linear predictive coefficients into LSP parameters is disclosed in N. Sugamura et al., "Speech Data Compression by LSP Speech Analysis-Synthesis Technique", Journal of the Electronic Communications Society of Japan, J64-A, 1981, pp.599–606 (hereinafter referred to as document 5). For example, linear predictive coefficients calculated for the second and fourth subframes based on the Burg method are converted into LSP parameters whereas LSP parameters of the first and third subframes are determined by linear interpolation, and the LSP parameters of the first and third subframes are inversely converted back into linear predictive coefficients. Then, the linear predictive coefficients $\alpha_{il}$ (i=1, . . . , 10, 1=1, . . . , 5) of the first to fourth subframes are outputted to the perceptual weighting circuit 230. The LSP parameters of the fourth subframe are outputted to the spectrum parameter quantization circuit 210.

The spectrum parameter quantization circuit 210 efficiently quantizes the LSP parameters of a predetermined subframe and outputs a quantization value which minimizes the distortion of the following equation (2):

$$D_j = \sum_{i=1}^{P} W(i)[LSP(i) - QLSP(i)_j]^2 \tag{2}$$

where LSP(i), $QLSP(i)_j$ and W(i) are the LSP parameter of the ith-order before quantization, the jth result after the quantization and the weighting coefficient, respectively.

In the following description, it is assumed that vector quantization is used as a quantization method, and LSP parameters of the fourth subframe are quantized. Any known technique can be employed as the technique for vector quantization of LSP parameters. Particularly, a technique disclosed in, for example, Japanese Patent Laid-Open Application No. Heisei 4-171500 (hereinafter referred to as document 6), Japanese Patent Laid-Open Application No. Heisei 4-363000 (hereinafter referred to as document 7), Japanese Patent Laid-Open Application No. Heisei 5-6199 (hereinafter referred to as document 8), T. Nomura et al., "LSP Coding VQ-SVQ with Interpolation in 4.075 kbps M-LCELP Speech Coder", Proc. Mobile Multimedia Communications, 1993, pp.B.2.5 (hereinafter referred to as document 9) or the like can be used. Accordingly, description of details of the technique is omitted herein.

The spectrum parameter quantization circuit 210 regenerates the LSP parameters of the first to fourth subframes based on the LSP parameters quantized with the fourth subframe. Here, linear interpolation of the quantization LSP parameters of the fourth subframe of the current frame and the quantization LSP parameters of the fourth subframe of the directly preceding frame is performed to regenerate LSP parameters of the first to third subframes. Here, after a code vector which minimizes the error power between the LSP parameters before quantization and the LSP parameters after quantization is selected, the LSP parameters of the first to fourth subframes are regenerated by linear interpolation. In order to further improve the performance, after a plurality of candidates are first selected as a code vector which minimizes the error power, the accumulated distortion may be evaluated with regard to each of the candidates to select a set of a candidate and an interpolation LSP parameter which exhibit a minimum accumulated distortion. Details are disclosed, for example, in Japanese Patent Laid-Open Application No. Heisei 6-222797 (hereinafter referred to as document 10).

The LSP parameters of the first to third subframes regenerated in such a manner as described above and the quantization LSP parameters of the fourth subframe are converted into linear predictive coefficients $\alpha'_{il}$ (i=1, . . . , 10, 1=1, . . . 5) for each subframe, and the linear predictive coefficients $\alpha'_{il}$ are outputted to the impulse response calculation circuit 310. Further, an index representative of the code vector of the quantization LSP parameters of the fourth subframe is outputted to the multiplexer 400.

The perceptual weighting circuit 230 receives the linear predictive coefficients $\alpha'_{il}$ (i=1, . . . , 10, 1=1, . . . , 5) before quantization for each subframe from the spectrum parameter calculation circuit 200, performs perceptual weighting for the speech signal of the subframe based on the technique of the document 1 and outputs a resulting perceptual weighting signal.

The response signal calculation circuit 240 receives the linear predictive coefficients $\alpha_{il}$ for each subframe from the spectrum parameter calculation circuit 200, receives the linear predictive coefficients $\alpha'_{il}$ regenerated by quantization and interpolation for each subframe from the spectrum parameter quantization circuit 210, calculates, for one subframe, a response signal with which the input signal is reduced to zero (d(n)=0) using a value of a filter memory stored therein, and outputs the response signal to the subtraction circuit 235. Here, the response signal $x_z(n)$ is represented by the following equation (3):

$$x_z(n) = d(n) - \sum_{i=1}^{10} \alpha_i d(n-i) + \sum_{i=1}^{10} \alpha_i \gamma^i y(n-i) + \sum_{i=1}^{10} \alpha'_i \gamma^i x_z(n-i) \tag{3}$$

where, when n−i≦0, $$y(n-i)=p(N+(n-i)) \tag{4}$$

$$x_z(n-i)=s_w(N+(n-i)) \tag{5}$$

where N is the subframe length, γ is the weighting coefficient for controlling the perceptual weighting amount and has a value equal to the value of an equation (7) given hereinbelow, and $s_w(n)$ and p(n) are an output signal of the weighting signal calculation circuit 360 and an output signal of the term of the denominator of a filter of the first term of the right side of the equation (7), respectively.

The subtraction circuit 235 subtracts response signals for one subframe from the perceptual weighting signal based on the following equation (6):

$$x'_w(n)=x_w(n)-x_z(n) \tag{6}$$

and outputs the signal $x'_w(n)$ to the adaptive codebook circuit 500.

The impulse response calculation circuit 310 calculates a predetermined number L of impulse responses $h_w(n)$ of a perceptual weighting filter whose z conversion is represented by the following equation (7):

$$H_w(z) = \frac{1 - \sum_{i=1}^{10} \alpha_i z^{-i}}{1 - \sum_{i=1}^{10} \alpha_i \gamma^i z^{-i}} \quad \frac{1}{1 - \sum_{i=1}^{10} \alpha'_i \gamma^i z^{-i}} \tag{7}$$

and outputs them to the adaptive codebook circuit 500 and the excitation quantization circuit 350.

The adaptive codebook circuit 500 receives the excitation signal v(n) in the past from the gain quantization circuit 365, receives the output signal $x'_w(n)$ from the subtraction circuit 235 and the impulse responses $h_w(n)$ from the impulse response calculation circuit 310. Then, the adaptive codebook circuit 500 calculate a delay T corresponding to the pitch so that the distortion of the following equation (8) may be minimized, and outputs an index representative of the delay to the multiplexer 400.

$$D_T = \sum_{n=0}^{N-1} x_w^2(n) - \left[ \sum_{n=0}^{N-1} x_w(n) y_w(n-T) \right]^2 / \left[ \sum_{n=0}^{N-1} y_w^2(n-T) \right] \tag{8}$$

where $$y_w(n-T) = v(n-T) * h_w(n) \tag{9}$$

where the symbol * signifies a convolution calculation.

$$\beta = \sum_{n=0}^{N-1} x_w(n) y_w(n-T) / \sum_{n=0}^{N-1} y_w^2(n-T) \tag{10}$$

Here, in order to improve the extraction accuracy of a delay with regard to voice of a woman or a child, the delay may be calculated not as an integer sample value but a decimal fraction sample value. A detailed method is disclosed, for example, in P. Kroon, "Pitch predictors with high terminal resolution", Proc. ICASSP, 1990, pp.661–664 (hereinafter referred to as document 11).

Further, the adaptive codebook circuit 500 performs pitch prediction based on the following equation (11) and outputs a resulting predictive residue signal $e_w(n)$ to the excitation quantization circuit 350.

$$e_w(n) = x_w(n) - \beta_v(n-T) * h_w(n) \tag{11}$$

The excitation quantization circuit 350 forms M pulses as described hereinbelow. The excitation quantization circuit 350 quantizes the position of at least one pulse with a predetermined number of bits, and outputs an index representative of the position to the multiplexer 400. As a method of searching for the position of a pulse, various methods wherein the positions of pulses are searched for sequentially one by one pulse have been proposed, and one of the methods is disclosed, for example, in K. Ozawa et al, "A study on pulse search algorithms for multipulse excited speech coder realization" (hereinafter referred to as document 12). Therefore, description of details of the method is omitted herein. Also the method disclosed in the document 3 or a method which will be hereinafter described in connection with equations (16) to (21) may be employed instead.

In this instance, the amplitude of at least one pulse is determined depending upon the position of it.

Here, it is assumed that, as an example, the amplitudes of two pulses from among M pulses are determined in advance depending upon a combination of the positions of the two pulses. If it is assumed now that if the first and second pulses can assume two different positions, four combinations of the positions of the pulses, that is, (1, 1), (1, 2), (2, 1) and (2, 2), are available, and corresponding to the combinations of the positions, available combinations of the amplitudes of the two pulses are, for example, (1.0, 1.0), (1.0, 0.1), (0.1, 1.0) and (0.1, 0.1). Since the amplitudes are determined in accordance with the combinations of the positions in advance, information for representation of the amplitudes need not be transmitted.

It is to be noted that the pulses other than the two pulses may have, for simplified operation, an amplitude such as, for example, 1.0 or −1.0 determined in advance without depending upon the positions.

The information of the amplitudes and the positions is outputted to the gain quantization circuit 365.

The gain quantization circuit 365 reads out gain code vectors from the gain codebook 390 and selects one of the gain code vectors so that, for the selected excitation code vector, the following equation (12) may be minimized. Here, it is assumed that both of the gain of the adaptive codebook and the gain of the excitation are vector quantized simultaneously.

$$D_k = \sum_{n=0}^{N-1} \left[ x_w(n) - \beta'_k v(n-T) * h_w(n) - G'_k \sum_{i=1}^{M} g_i h_w(n-m_i) \right]^2 \tag{12}$$

where $\beta'_k$ and $G'_k$ are kth code vectors in a two-dimensional gain codebook stored in the gain codebook 390. An index representative of the selected gain code vector is outputted to the multiplexer 400.

The weighting signal calculation circuit 360 receives output parameters of the spectrum parameter calculation circuit 200 and the individual indices, and reads out code vectors corresponding to the indices. Then, the weighting signal calculation circuit 360 calculates an excitation signal v(n) based on the following equation (13):

$$v(n) = \beta'_k v(n-T) + G'_k \sum_{i=1}^{M} \delta(n-m_i) \tag{13}$$

The excitation signal v(n) is outputted to the adaptive codebook circuit 500.

Then, the weighting signal calculation circuit 360 calculates the response signal sw(n) for each subframe based on the following equation (14) using the output parameters of the spectrum parameter calculation circuit 200 and the output parameters of the spectrum parameter quantization circuit 210, and outputs the response signal $s_w(n)$ to the response signal calculation circuit 240.

$$s_w(n) = v(n) - \sum_{i=1}^{10} \alpha_i v(n-i) + \sum_{i=1}^{10} \alpha_i \gamma^i p(n-i) + \sum_{i=1}^{10} \alpha'_i \gamma^i s_w(n-i) \tag{14}$$

Figure 2:
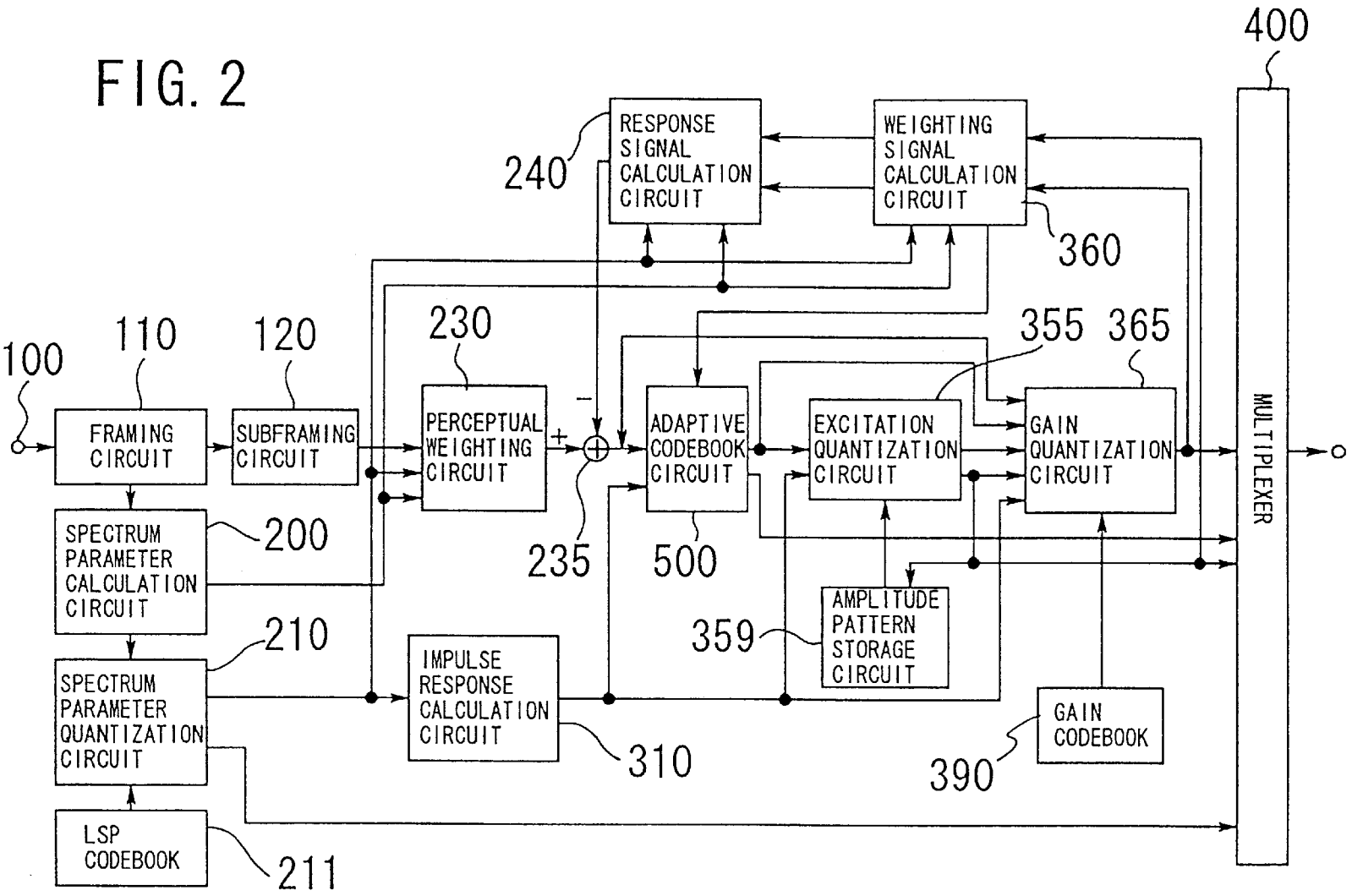
FIGS. 2 and 3 are similar views but showing modifications to the speech coding apparatus of FIG. 1.

FIG. 2 shows in block diagram a modification to the speech coding apparatus of the first embodiment of the present invention described hereinabove with reference to FIG. 1. Referring to FIG. 2, the modified speech coding apparatus is different from the speech coding apparatus of the first embodiment only in that it includes, in place of the excitation quantization circuit 350, an excitation quantization circuit 355 which operates in a somewhat different manner from the excitation quantization circuit 350, and additionally includes an amplitude pattern storage circuit 359. In the modified speech coding apparatus, amplitude values of pulses are stored as amplitude patterns in the amplitude pattern storage circuit 359, and position information of a pulse is inputted to the amplitude pattern storage circuit 359 to read out one of the amplitude patterns. Those patterns are learned using a data base of a large amount of speech data depending upon a combination of positions of pulses and is determined decisively depending upon positions.

Figure 3:
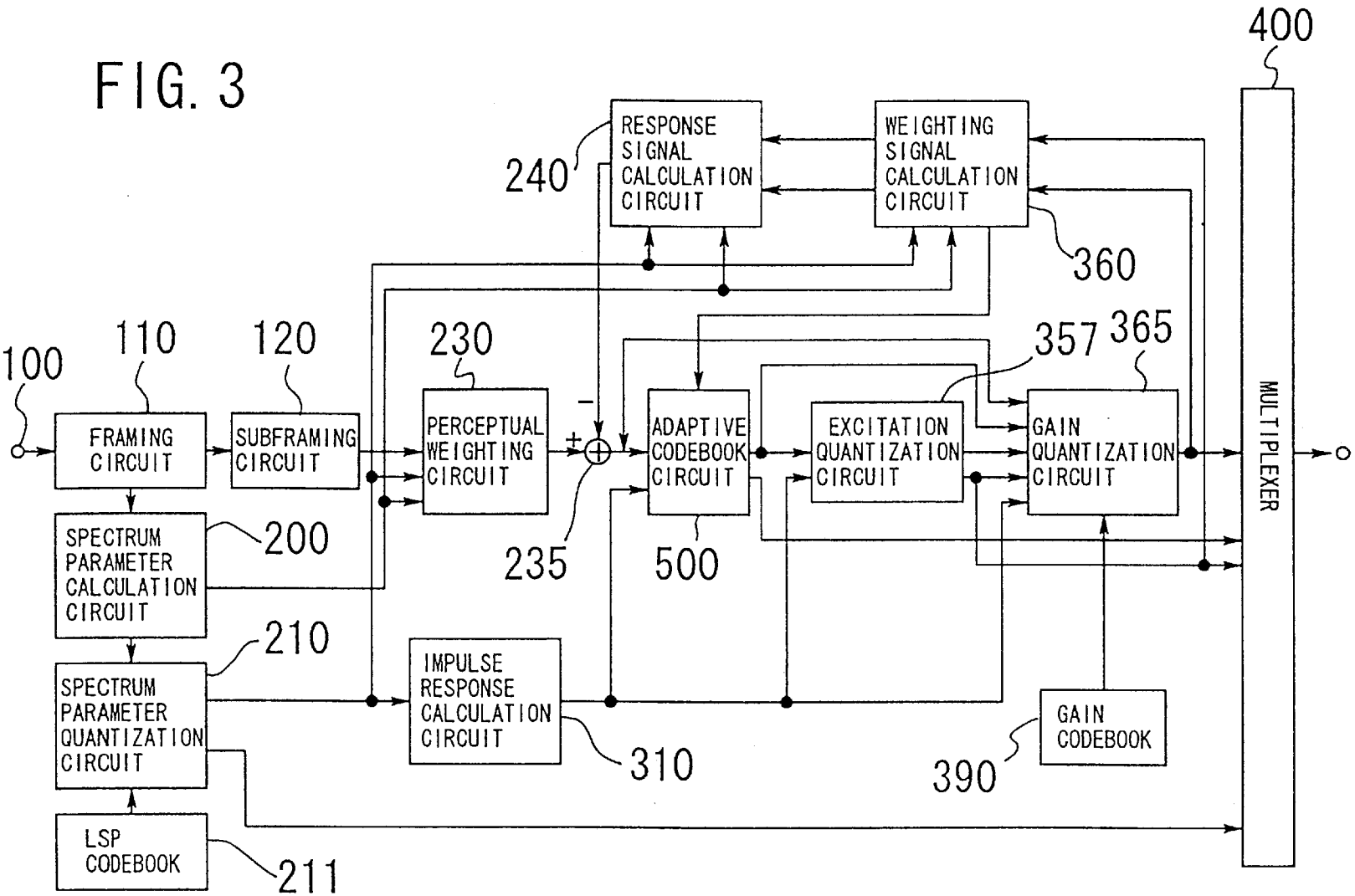

FIG. 3 shows in block diagram another modification to the speech coding apparatus of the first embodiment of the present invention described hereinabove with reference to FIG. 1. Referring to FIG. 3, the modified speech coding apparatus shown is different from the speech coding apparatus of the first embodiment only in that it includes an excitation quantization circuit 357 in place of the excitation quantization circuit 350. In the modified speech coding apparatus, the position which may be assumed by each pulse is limited in advance by the excitation quantization circuit 357. The position of each pulse may be, for example, an even-numbered sample position, an odd-numbered sample position or every Lth sample position. Here, it is assumed that every Lth sample position is assumed, and the value of L is selected in accordance with the following equation:

$$L=N/M \tag{15}$$

where N and M are the subframe length and the number of pulses, respectively.

It is to be noted that the amplitude of at least one pulse may be determined in advance depending upon the position of the pulse.

Figure 4:
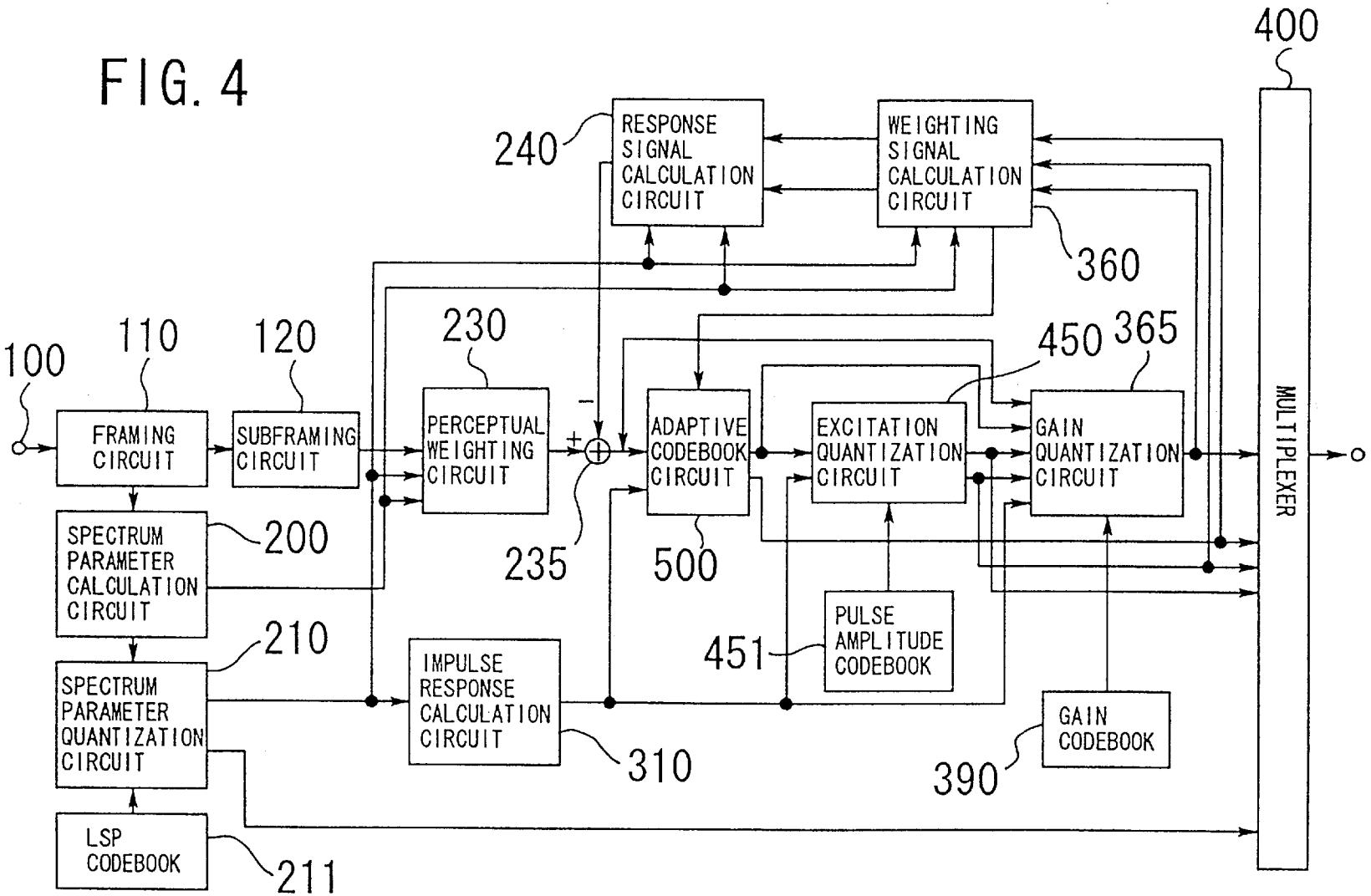
FIG. 4 is a similar view but showing a further modification to the speech coding apparatus of FIG. 1.

FIG. 4 shows in block diagram a further modification to the speech coding apparatus of the first embodiment of the present invention described hereinabove with reference to FIG. 1. Referring to FIG. 4, the modified speech coding apparatus is different from the speech coding apparatus of the first embodiment only in that it includes an excitation quantization circuit 450 in place of the excitation quantization circuit 350 and additionally includes a pulse amplitude codebook 451. In the modified speech coding apparatus, the excitation quantization circuit 450 calculates the positions of pulses by the same method as in the speech coding apparatus of the first embodiment, and quantizes and outputs the pulse positions to the multiplexer 400 and the gain quantization circuit 365.

Further, the excitation quantization circuit 450 vector quantizes the amplitudes of a plurality of pulses simultaneously. In particular, the excitation quantization circuit 450 reads out pulse amplitude code vectors from the pulse amplitude codebook 451 and selects one of the amplitude code vectors which minimizes the distortion of the following equation (16):

$$D_k=\sum_{n=0}^{N-1}\left[e_w(n)-G\sum_{i=1}^{M}g'_{ik}h_w(n-m_i)\right]^2 \tag{16}$$

where G is the optimum gain, and $g'_{ik}$ is the ith pulse amplitude of the kth amplitude code vector.

The minimization of the equation (16) can be formulated in the following manner. If the equation (16) is partially differentiated with the amplitude $g'_i$ of a pulse and then set to 0, then $$D_k=\sum_{n=0}^{N-1}[e_w(n)/G]^2-\left[\sum_{n=0}^{N-1}\phi(n)v_k(n)\right]^2\Big/\left[\sum_{i=1}^{M}g'_{ik}h_w(n-m_i)\right]^2 \tag{17}$$

where $$\phi(n)=\sum_{i=n}^{N-1}e_w(i)h_w(i-n),\quad n=0,\ldots,N-1 \tag{18}$$

$$v_k(n)=\sum_{i=1}^{M}g'_{ik}\delta(n-m_i) \tag{19}$$

Accordingly, the minimization of the equation (16) is equivalent to maximization of the second term of the right side of the equation (17).

The denominator of the second term of the right side of the equation (17) can be transformed into the following equation (20):

$$\left[\sum_{i=1}^{M}g'_{ik}h_w(n-m_i)\right]^2=\sum_{i=1}^{M}g'^2_{ik}\Psi(m_i,m_i)+2\sum_{i=1}^{M-1}\sum_{j=i+1}^{M}g'_{ik}g'_{jk}\Psi(m_i,m_j) \tag{20}$$

where

-continued $$\Psi(m_i,m_j)=\sum_{n=j}^{N-1}h(n-i)h(n-j),\ j\geqq i \tag{21}$$

Accordingly, by calculating $g'^2_{ik}$ and $g'_{ik}g'_{jk}$ of the equation (20) for each amplitude code vector k in advance and storing them in a codebook, the quantity of calculation required can be reduced remarkably. Further, if $\phi$ and $\psi$ are calculated once for each subframe, then the quantity of calculation can be further reduced.

The number of product sum calculations necessary for amplitude quantization in this instance is approximately $N^2+[(M-1)!+M]2^B+NL+M2^B$ per subframe where M is the number of pulses per subframe, N the subframe length, L the impulse response length, and B the bit number of the amplitude codebook. When B=10, N=40, M=4 and L=20, the quantity of product sum calculation is 3,347,200 per one second. Further, in searching for the position of a pulse, if the method 1 disclosed in the document 12 is used, then since no calculation quantity is produced newly with respect to the calculation quantity described above, the calculation quantity is reduced to approximately 1/24 comparing with those of the conventional methods of the documents 1 and 2.

Accordingly, it can be seen that, where the method of the present invention is employed, the quantity of calculation required for searching for the amplitude and the position of a pulse is very small compared with those of the conventional methods.

The excitation quantization circuit 450 outputs an index of the amplitude code vector selected by the method described above to the multiplexer 400. Further, the excitation quantization circuit 450 outputs the position of each pulse and the amplitude of each pulse by an amplitude code vector to the gain quantization circuit 365.

The pulse amplitude codebook 451 can be replaced by pulse polarity codebook. In that case, polarities of plural pulses are vector quantized simultaneously.

Figure 5:
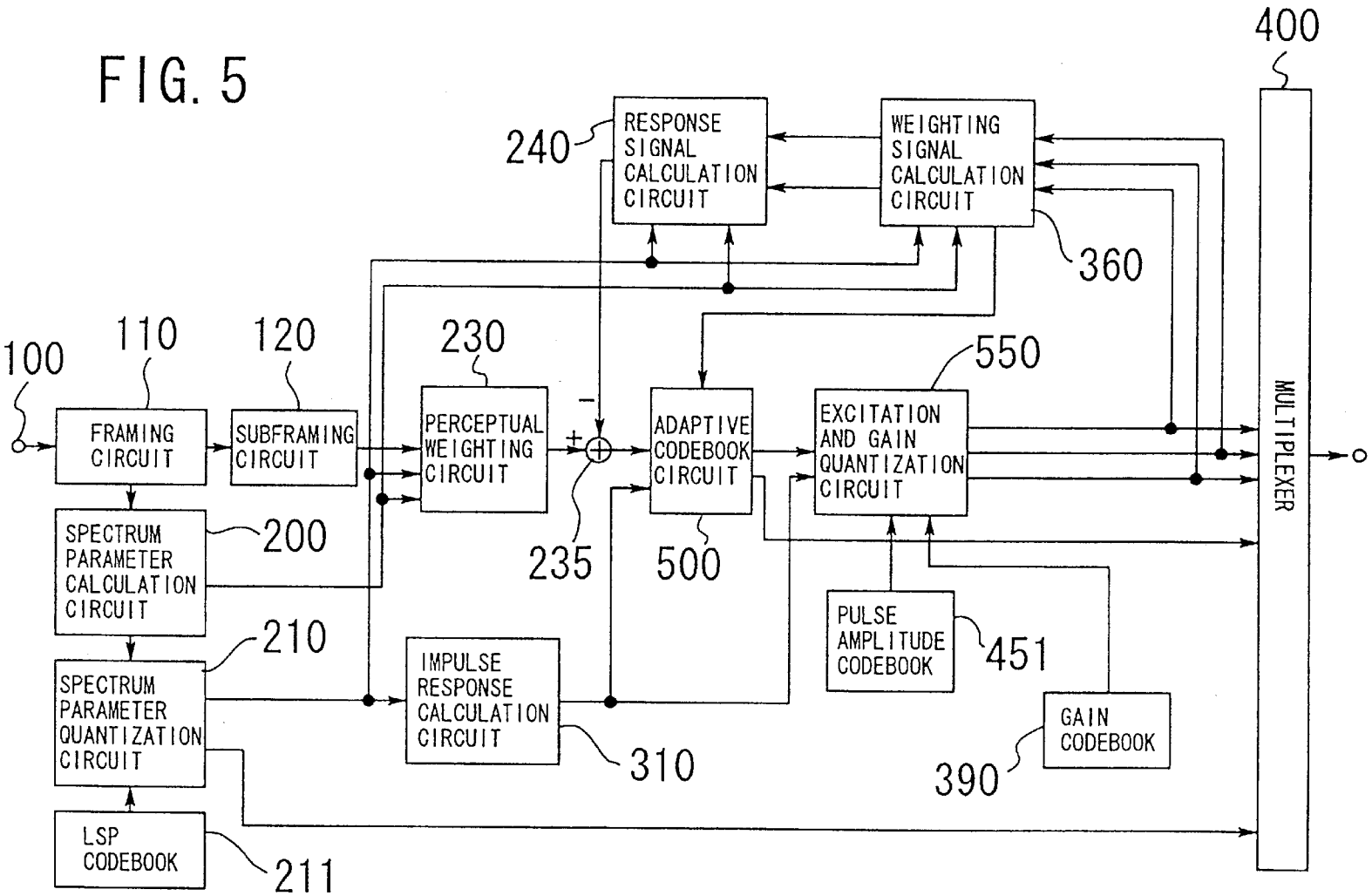
FIGS. 5 to 7 are similar views but showing modifications to the modified speech coding apparatus of FIG. 4.

FIG. 5 shows in block diagram a modification to the modified speech coding apparatus described hereinabove with reference to FIG. 4. Referring to FIG. 5, the modified speech coding apparatus is different from the modified speech coding apparatus of FIG. 4 in that it includes a single excitation and gain quantization circuit 550 in place of the excitation quantization circuit 450 and the gain quantization circuit 365. In the modified speech coding apparatus, the excitation and gain quantization circuit 550 performs both of quantization of gains and quantization of amplitudes of pulses. The excitation and gain quantization circuit 550 calculates the positions of pulses and quantizes them using the same methods as those employed in the excitation quantization circuit 450. The amplitude and the gain of a pulse are quantized simultaneously selecting a pulse amplitude code vector and a gain code vector from within the pulse amplitude codebook 451 and the gain codebook 390, respectively, so that the following equation (22) may be minimized.

$$D_k=\sum_{n=0}^{N-1}\left[x_w(n)-\beta'_k v(n-T)*h_w(n)-G'_k\sum_{i=1}^{M}g'_{ik}h_w(n-m_i)\right]^2 \tag{22}$$

where $g'_{ik}$ is the ith pulse amplitude of the kth pulse amplitude code vector, $\beta'_k$ and $G'_k$ are kth code vectors of the two dimensional gain codebook stored in the gain codebook 390. From all combinations of pulse amplitude vectors and gain code vectors, one optimum combination can be selected so that the equation (22) above may be minimized.

Further, pre-selection may be introduced in order to reduce the searching calculation quantity. For example, a plurality of pulse amplitude code vectors are preliminarily selected in an ascending order of the distortion of the equation (16) or (17), and a gain codebook is searched for each candidate, whereafter, from the thus searched out gain codebooks, one combination of a pulse amplitude code vector and a gain code vector which minimizes the equation (22) is selected.

Then, an index representative of the selected pulse amplitude code vector and gain code vector is outputted to the multiplexer 400.

The pulse amplitude codebook 451 can be replaced by pulse polarity codebook. In that case, polarities of plural pulses are vector quantized simultaneously.

Figure 6:
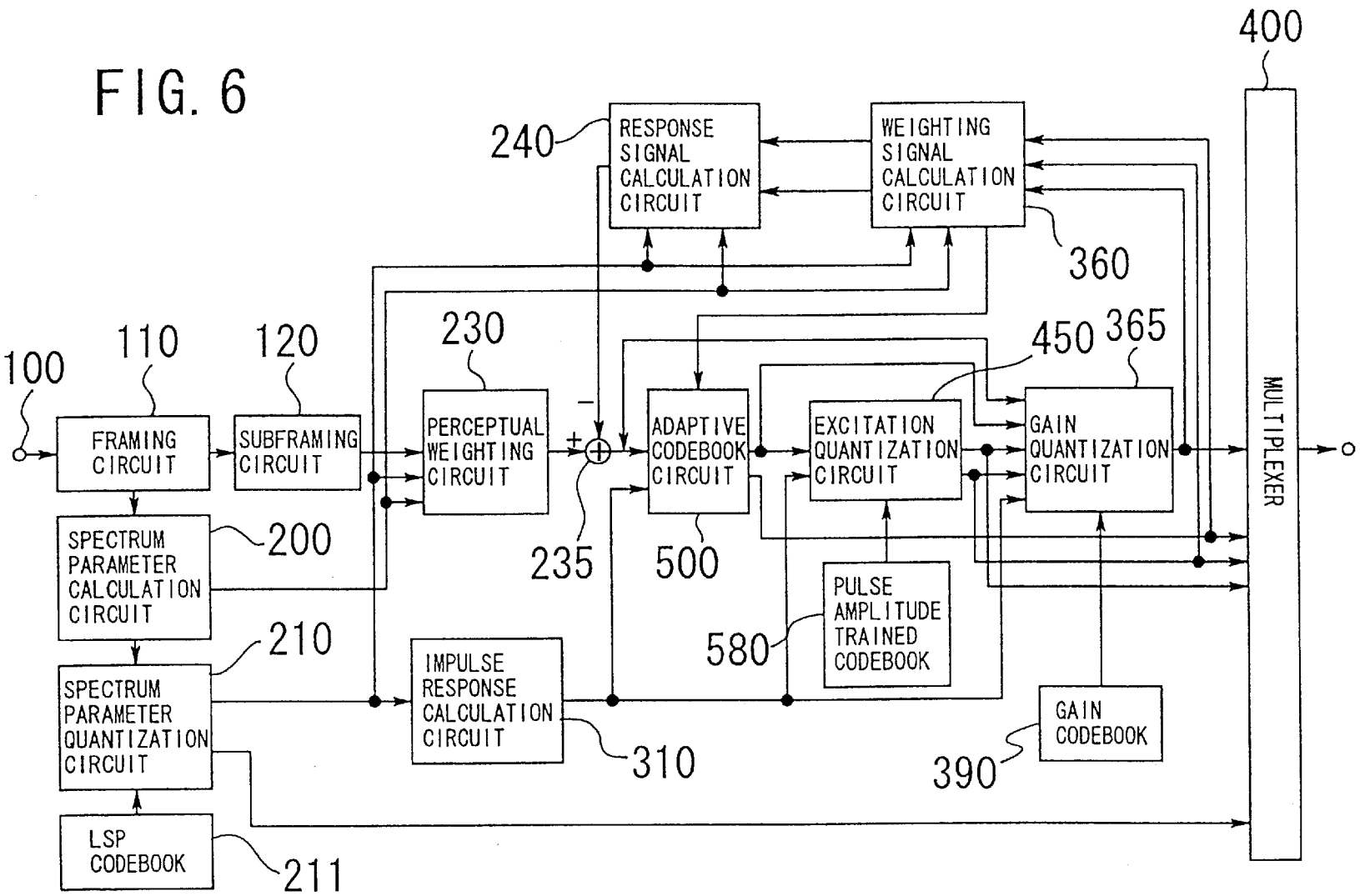

FIG. 6 shows in block diagram another modification to the modified speech coding apparatus described hereinabove with reference to FIG. 4. Referring to FIG. 6, the modified speech coding apparatus is different from the modified speech coding apparatus of FIG. 4 only in that it includes a pulse amplitude trained codebook 580 in place of the pulse amplitude codebook 451. The pulse amplitude trained codebook 580 is produced by training in advance, using a speech signal, a codebook for simultaneous quantization of the amplitudes or polarities of a plurality of pulses. A training method for the codebook is disclosed, for example, in Linde et al., "An algorithm for vector quantization design", IEEE Trans. Commun., January 1980, pp.84–95 (hereinafter referred to as document 13).

It is to be noted that the modified speech coding apparatus of FIG. 6 may be further modified such that a gain is quantized with a gain codebook while a pulse amplitude is quantized with a pulse amplitude codebook similarly as in the speech coding apparatus of FIG. 5.

Figure 7:
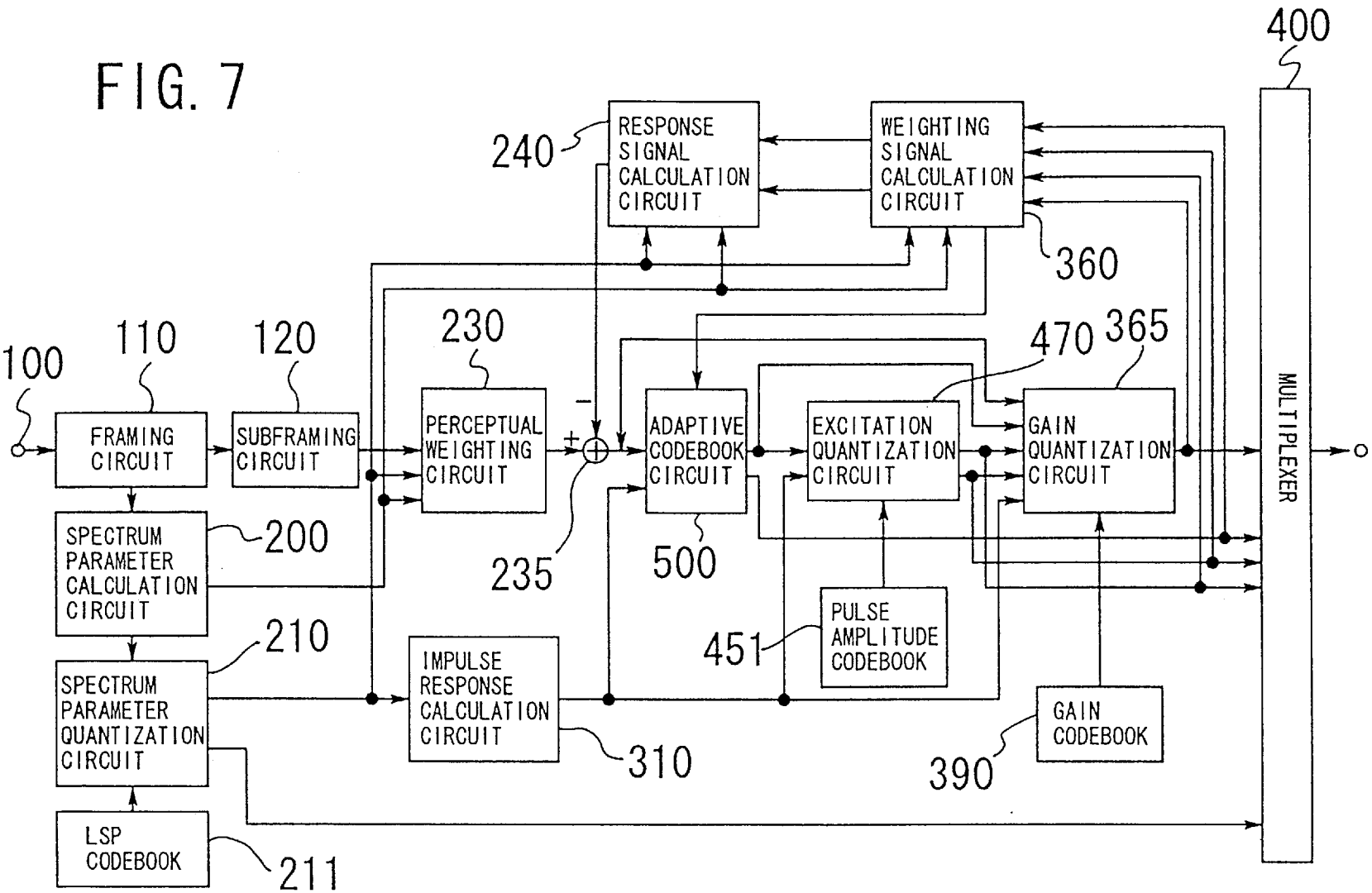

FIG. 7 shows in block diagram a further modification to the modified speech coding apparatus described hereinabove with reference to FIG. 4. Referring to FIG. 7, the modified speech coding apparatus is different from the modified speech coding apparatus of FIG. 4 only in that it includes an excitation quantization circuit 470 in place of the excitation quantization circuit 450. In particular, the position which can be assumed by each pulse is limited in advance. The position of each pulse may be, for example, an even-numbered sample position, an odd-numbered sample position or every Lth sample position. Here, it is assumed that every Lth sample position is used, and the value of L is selected in accordance with the equation (13) given hereinabove.

It is to be noted that the amplitudes or polarities of a plurality of pulses may be quantized simultaneously using a codebook.

Figure 8:
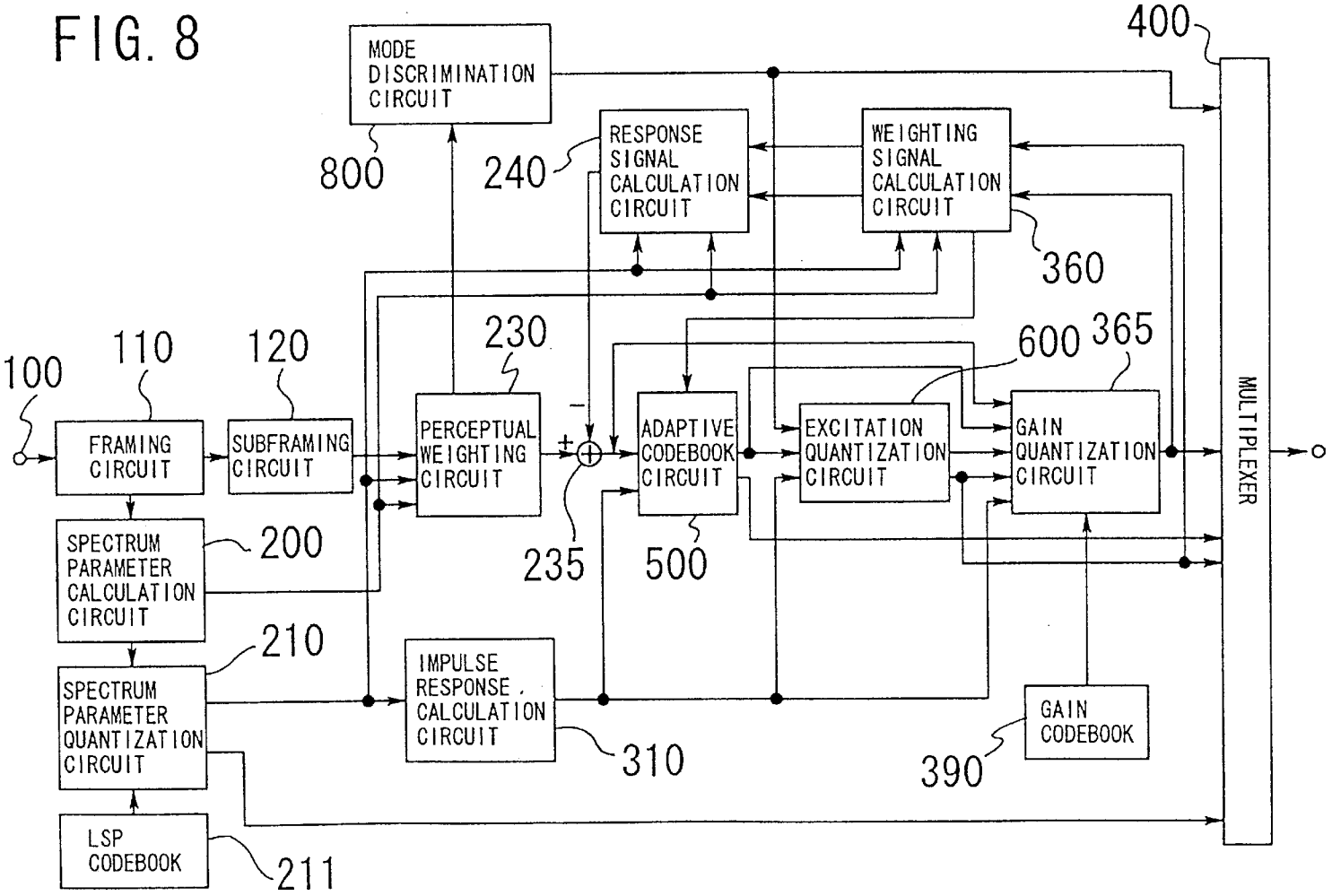
FIG. 8 is a similar view but showing a speech coding apparatus according to another preferred embodiment of the present invention.

FIG. 8 shows in block diagram a speech coding apparatus according to another preferred embodiment of the present invention. Referring to FIG. 8, the speech coding apparatus is a modification to the speech coding apparatus of the first embodiment described hereinabove with reference to FIG. 1. The speech coding apparatus of the present embodiment is different from the speech coding apparatus of the first embodiment in that it includes an excitation quantization circuit 600 in place of the excitation quantization circuit 350 and additionally includes a mode discrimination circuit 800.

The mode discrimination circuit 800 receives a perceptual weighting signal in units of a frame from the perceptual weighting circuit 230 and outputs mode discrimination information. Here, a characteristic amount of a current frame is used for discrimination of a mode. The characteristic amount may be, for example, a pitch predictive gain averaged in a frame. For calculation of the pitch predictive gain, for example, the following equation (23) is used:

$$G = 10\log_{10}\left[ (1/L) \sum_{i=1}^{L} (P_i/E_i) \right] \tag{23}$$

where L is the length of subframes included in the frame, and $P_i$ and $E_i$ are the speech power and the pitch predictive error power of the ith subframe, respectively.

$$P_i = \sum_{n=0}^{N-1} x_{wi}^2(n) \tag{24}$$

$$E_i = P_i - \left[ \sum_{n=0}^{N-1} x_{wi}(n)x_{wi}(n-T) \right]^2 / \left[ \sum_{n=0}^{N-1} x_{wi}^2(n-T) \right] \tag{25}$$

where T is the optimum delay which maximizes the predictive gain.

The frame average pitch predictive gain G is compared with a plurality of threshold values to classify it into a plurality of different modes. The number of modes may be, for example, 4. The mode discrimination circuit 800 outputs the mode identification information to the excitation quantization circuit 600 and the multiplexer 400.

The excitation quantization circuit 600 performs the following processing when the mode identification information represents a predetermined mode.

Where M pulses are to be determined as seen from the equation (1) given hereinabove, the excitation quantization circuit 600 quantizes the position of at least one pulse with a predetermined number of bits and outputs an index representative of the position to the multiplexer 400. In this instance, the amplitude of the at least one pulse is determined depending upon the position in advance.

Here, it is assumed that, as an example, the amplitudes of two pulses from among M pulses are determined in advance depending upon a combination of the positions of the two pulses. If it is assumed now that if the first and second pulses can assume two different positions, four combinations of the positions of the two pulses, that is, (1, 1), (1, 2), (2, 1) and (2, 2), are available, and corresponding to the combinations of the positions, available combinations of the amplitudes of the two pulses are, for example, (1.0, 1.0), (1.0, 0.1), (0.1, 1.0) and (0.1, 0.1). Since the amplitudes are determined in accordance with the combinations of the positions in advance, information for representation of the amplitudes need not be transmitted.

It is to be noted that the pulses other than the two pulses may have, for simplified operation, an amplitude such as, for example, 1.0 or −1.0 determined in advance without depending upon the positions.

The information of the amplitudes and the positions is outputted to the gain quantization circuit 365.

Figure 9:
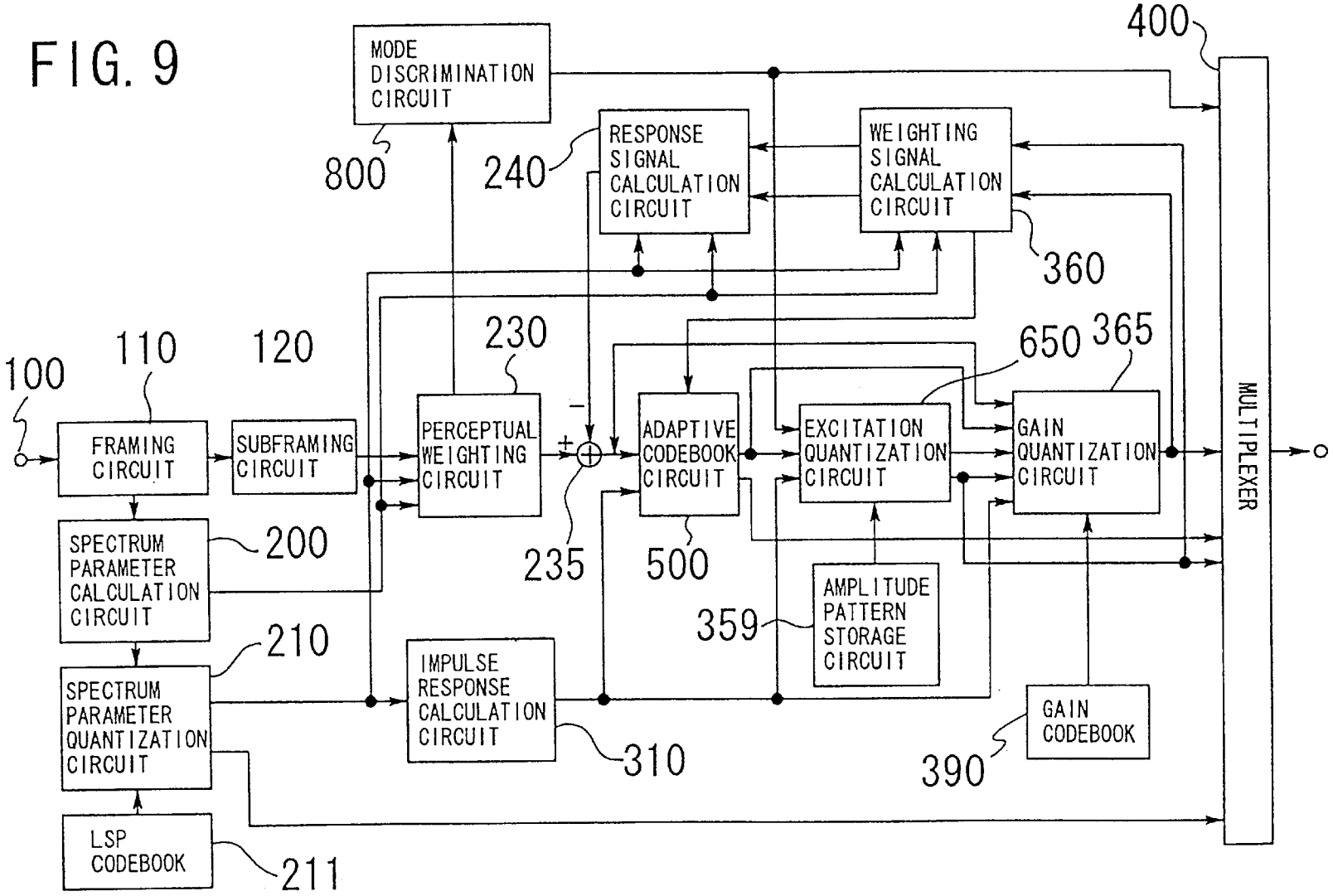
FIGS. 9 to 13 are similar views but showing modifications to the speech coding apparatus of FIG. 8.

FIG. 9 shows in block diagram a modification to the speech coding apparatus of the embodiment described hereinabove with reference to FIG. 8. Referring to FIG. 9, the modified speech coding apparatus is different from the speech coding apparatus of FIG. 8 only in that it includes an excitation quantization circuit 650 in place of the excitation quantization circuit 600 and additionally includes an amplitude pattern storage circuit 359. The excitation quantization circuit 650 receives discrimination information from the mode discrimination circuit 800 and, when the discrimination information represents a predetermined mode, the excitation quantization circuit 650 receives position information of a pulse to read out one of patterns of amplitude values of pulses from the amplitude pattern storage circuit 359.

Those patterns are trained using a data base of a large amount of speech data depending upon a combination of positions of pulses and is determined decisively depending upon positions. The training method disclosed in the document 13 mentioned hereinabove can be used as the training method in this instance.

Figure 10:
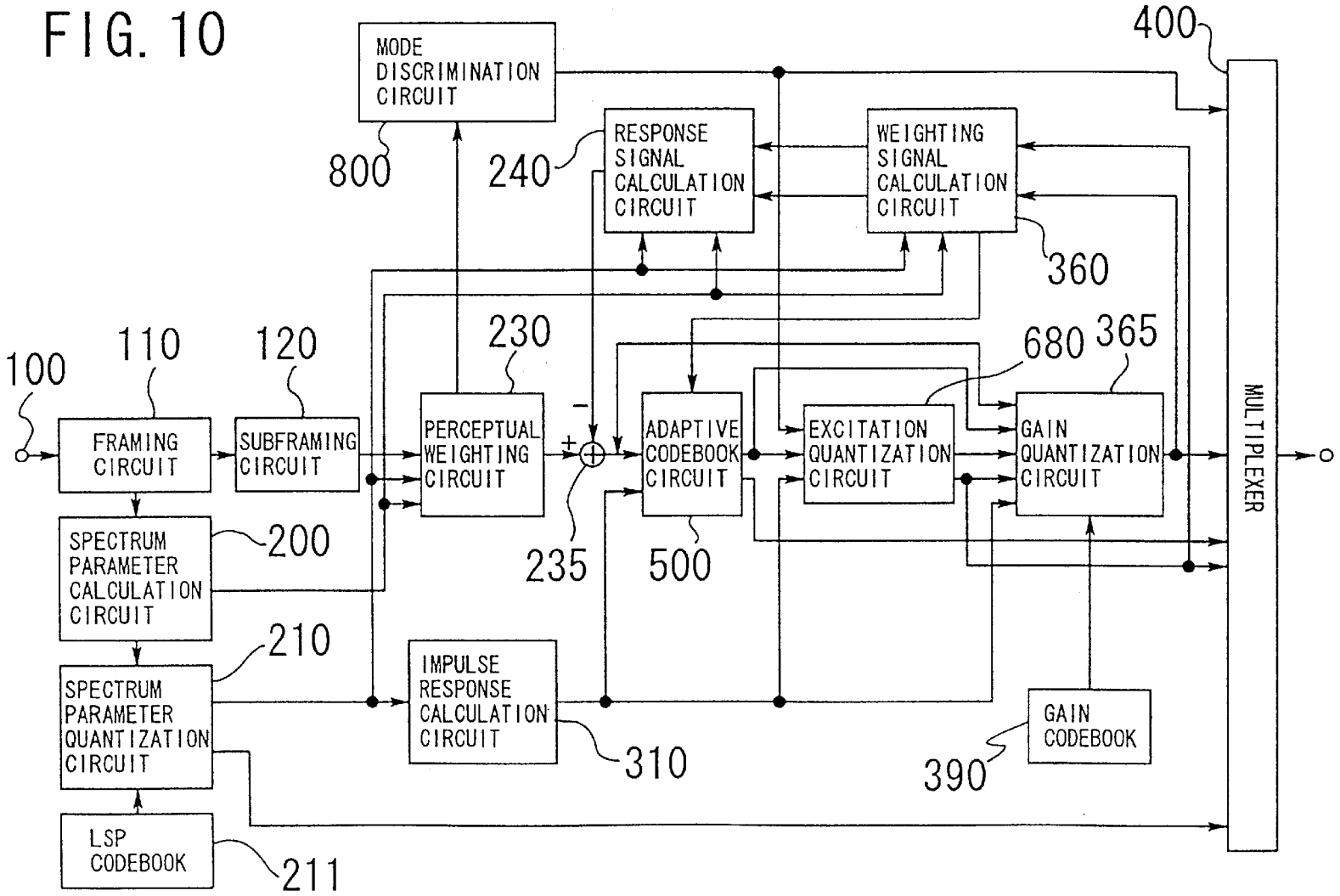

FIG. 10 shows in block diagram another modification to the speech coding apparatus of the embodiment described hereinabove with reference to FIG. 8. Referring to FIG. 10, the modified speech coding apparatus is different from the speech coding apparatus of FIG. 8 only in that it includes an excitation quantization circuit 680 in place of the excitation quantization circuit 600. The excitation quantization circuit 680 receives discrimination information from the mode discrimination circuit 800 and, when the discrimination information represents a predetermined mode, the position which can be assumed by each pulse is limited in advance. The position of each pulse may be, for example, an even-numbered sample position, an odd-numbered sample position or every Lth sample position. Here, it is assumed that every Lth sample position is assumed, and the value of L is selected in accordance with the equation (15) given hereinabove.

It is to be noted that the amplitude of at least one pulse may be learned as an amplitude pattern in advance depending upon the position of the pulse.

Figure 11:
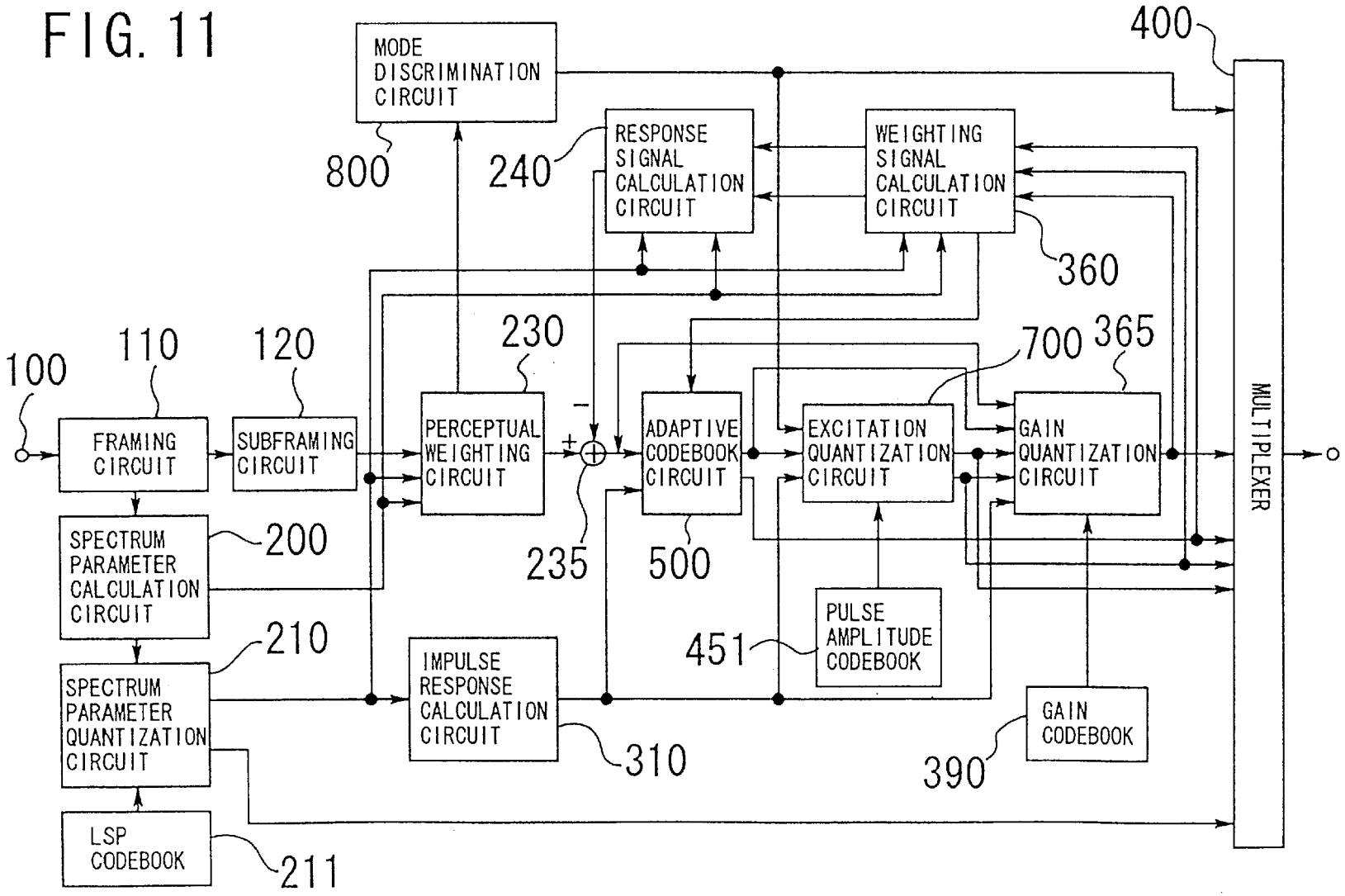

FIG. 11 shows in block diagram a further modification to the speech coding apparatus of the embodiment described hereinabove with reference to FIG. 8. Referring to FIG. 11, the modified speech coding apparatus is different from the speech coding apparatus of FIG. 8 only in that it includes an excitation quantization circuit 700 in place of the excitation quantization circuit 600 and additionally includes a pulse amplitude codebook 451. The excitation quantization circuit 700 receives discrimination information from the mode discrimination circuit 800 and, when the discrimination information represents a predetermined mode, the excitation quantization circuit 700 quantizes the position of at least one pulse with a predetermined number of bits and outputs an index to the gain quantization circuit 365 and the multiplexer 400. Then, the excitation quantization circuit 700 vector quantizes the amplitudes of a plurality of pulses simultaneously. Then, the excitation quantization circuit 700 reads out pulse amplitude code vectors from the pulse amplitude codebook 451 and selects one of the amplitude code vectors which minimizes the distortion of the equation (14) given hereinabove. Then, the excitation quantization circuit 700 outputs an index of the selected amplitude code vector to the gain quantization circuit 365 and the multiplexer 400.

It is to be noted that the modified speech coding apparatus of FIG. 11 may be further modified such that a gain is quantized with a gain codebook while a pulse amplitude is quantized with a pulse amplitude codebook using the equation (17) given hereinabove.

Figure 12:
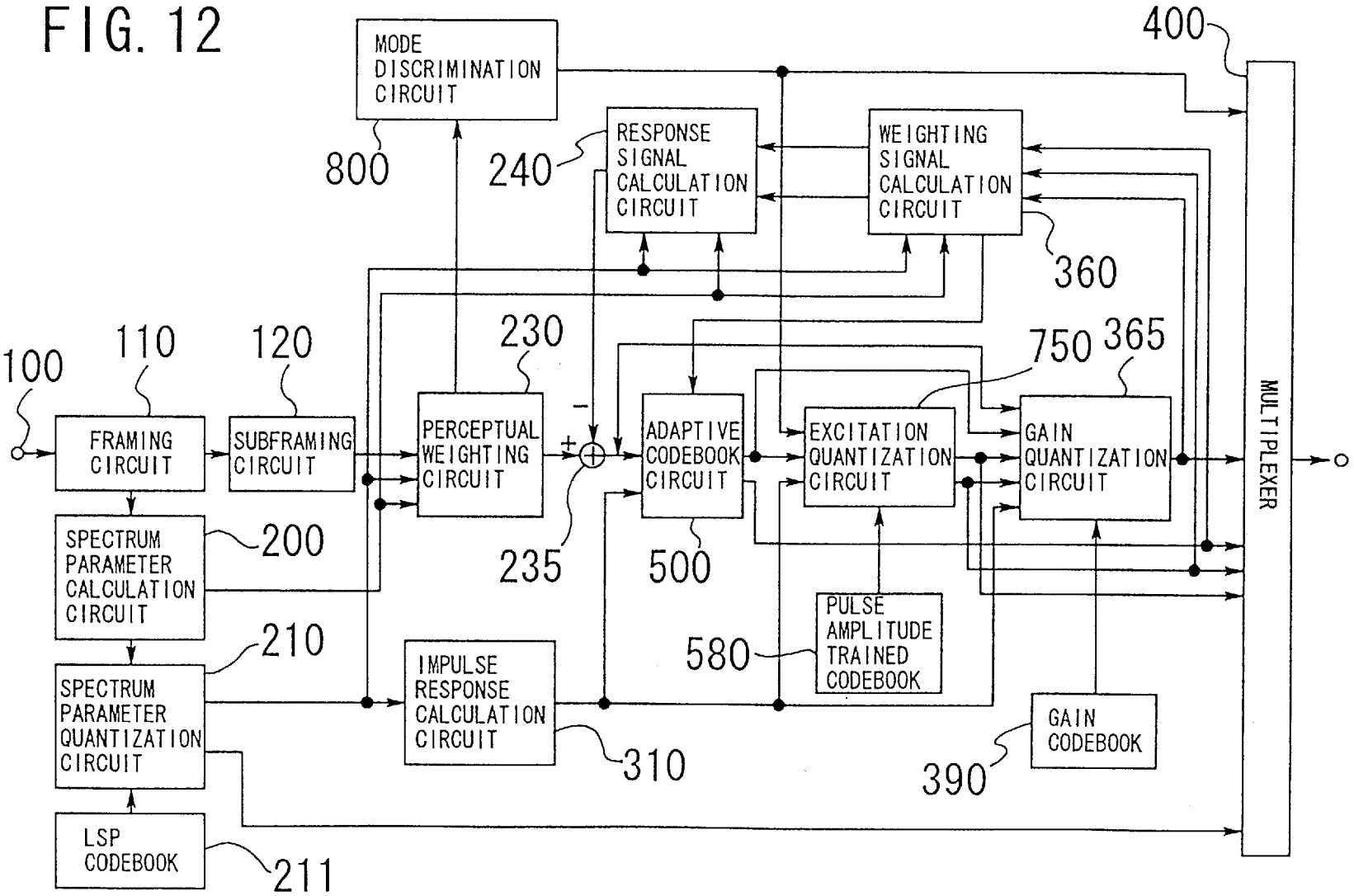

FIG. 12 shows in block diagram a still further modification to the speech coding apparatus of the embodiment described hereinabove with reference to FIG. 8. Referring to FIG. 12, the modified speech coding apparatus is different from the speech coding apparatus of FIG. 8 only in that it includes an excitation quantization circuit 750 in place of the excitation quantization circuit 600 and additionally includes a pulse amplitude trained codebook 580. The excitation quantization circuit 750 receives discrimination information from the mode discrimination circuit 800 and, when the discrimination information represents a predetermined mode, the excitation quantization circuit 750 quantizes the position of at least one pulse with a predetermined number of bits and outputs an index to the gain quantization circuit 365 and the multiplexer 400. Then, the excitation quantization circuit 750 vector quantizes the amplitudes of a plurality of pulses simultaneously. Then, the excitation quantization circuit 750 reads out pulse amplitude code vectors trained in advance from the pulse amplitude training codebook 580 and selects one of the amplitude code vectors which minimizes the distortion of the equation (14) given hereinabove. Then, the excitation quantization circuit 750 outputs an index of the selected amplitude code vector to the gain quantization circuit 365 and the multiplexer 400.

It is to be noted that the modified speech coding apparatus of FIG. 12 may be further modified such that a gain is quantized with a gain codebook while a pulse amplitude is quantized with a pulse amplitude codebook using the equation (22) given hereinabove.

Figure 13:
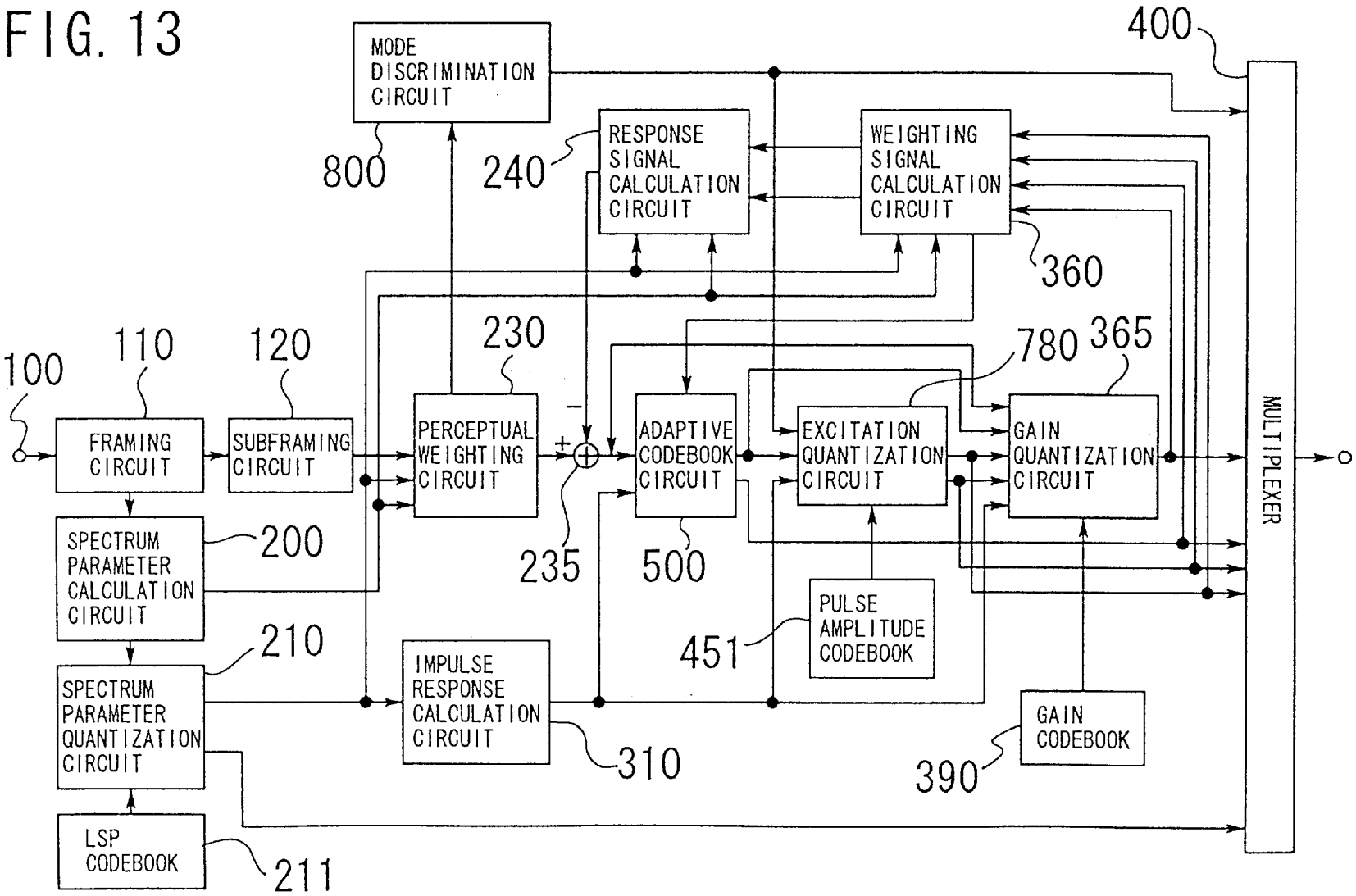

FIG. 13 shows in block diagram a yet further modification to the speech coding apparatus of the embodiment described hereinabove with reference to FIG. 8. Referring to FIG. 13, the modified speech coding apparatus is different from the speech coding apparatus of FIG. 8 only in that it includes an excitation quantization circuit 780 in place of the excitation quantization circuit 600 and additionally includes a pulse amplitude codebook 451. The excitation quantization circuit 780 receives discrimination information from the mode discrimination circuit 800 and, when the discrimination information represents a predetermined mode, the excitation quantization circuit 700 quantizes the position of at least one pulse with a predetermined number of bits and outputs an index to the gain quantization circuit 365 and the multiplexer 400. Here, the position which can be assumed by each pulse is limited in advance. The position of each pulse may be, for example, an even-numbered sample position, an odd-numbered sample position or every Lth sample position. Here, it is assumed that every Lth sample position is assumed, and the value of L is selected in accordance with the equation (15) given hereinabove. Then, the excitation quantization circuit 780 outputs an index to the gain quantization circuit 365 and the multiplexer 400.

It is to be noted that the modified speech coding apparatus of FIG. 13 may be further modified such that a gain is quantized with a gain codebook while a pulse amplitude is quantized with a pulse amplitude codebook using the equation (22) given hereinabove.

It is to be noted that such a codebook trained in advance as described hereinabove in connection with the modified speech coding apparatus of FIG. 11 may be used as the pulse amplitude codebook 451 in any of the speech coding apparatus of the embodiments described hereinabove which include such pulse amplitude codebook 451.

It is to be noted that the speech coding apparatus of the embodiment of FIG. 8 and the modifications to it may be modified such that the mode discrimination information from the mode discrimination circuit is used to change over the adaptive codebook circuit or the gain codebook.

Having now fully described the invention, it will be apparent to one of ordinary skill in the art that many changes and modifications can be made thereto without departing from the spirit and and scope of the invention as set forth herein.

What is claimed is:

1. A speech coding apparatus for calculating a spectral parameter from a speech signal inputted thereto, quantizing an excitation signal of the speech signal using the spectral parameter and outputting the quantized excitation signal, comprising:

an excitation quantization section for quantizing the excitation signal using a plurality of pulses, each pulse being defined by a position and an amplitude, wherein a position of at least one pulse is determined from N possible position variations of said at least one pulse, N being set in advance to be greater than one, and wherein an amplitude value is set in advance for each of said N possible position variations of said at least one pulse and an amplitude of said at least one pulse is determined as the amplitude value corresponding to the determined position of the said at least one pulse.

2. A speech coding apparatus as claimed in claim 1, wherein the amplitude value for each of the N possible position variations of the at least one pulse is trained using a plurality of speech signals.

3. A speech coding apparatus as claimed in claim 2, wherein the N possible positions variations of the at least one pulse is limited in advance.

4. A speech coding apparatus as claimed in claim 1, wherein the N possible positions variations of the at least one pulse is limited in advance.

5. A speech coding apparatus as claimed in claim 1, wherein said at least one pulse comprises two pulses and two amplitude values are set in advance for each of the N possible position variations of the two pulses.

6. A speech coding apparatus as claimed in claim 5, further comprising an amplitude pattern storage section for storing the two amplitude values for each of the N possible position variations of the two pulses as amplitude patterns.

7. A speech coding apparatus as claimed in claim 6, wherein the amplitude patterns are learned using a database of a large amount of speech data.

8. A speech coding apparatus for calculating a spectral parameter from a speech signal inputted thereto, quantizing an excitation signal of the speech signal using the spectral parameter and outputting the quantized excitation signal, comprising:

an excitation quantization section for quantizing the excitation signal using a plurality of pulses, each pulse being defined by a position and an amplitude, wherein a position of at least one pulse is determined from N possible position variations of said at least one pulse, N being set in advance to be greater than one, and wherein an amplitude or polarity of the at least one pulse is quantized simultaneously with amplitudes and polarities of the remaining plurality of pulses.

9. A speech coding apparatus as claimed in claim 8, further comprising a codebook determined in advance using a plurality of speech signals, said excitation quantization section using said codebook to quantize the amplitudes or polarities of the plurality of pulses simultaneously.

10. A speech coding apparatus as claimed in claim 9, wherein the N possible positions variations of the at least one pulse is limited in advance.

11. A speech coding apparatus as claimed in claim 8, wherein the N possible positions variations of the at least one pulse is limited in advance.

12. A speech coding apparatus for calculating a spectral parameter from a speech signal inputted thereto, quantizing an excitation signal of the speech signal using the spectral parameter and outputting the quantized excitation signal, comprising:

a mode discrimination section for discriminating a mode from the speech signal inputted thereto and outputting discrimination information; and an excitation quantization section for quantizing the excitation signal using a plurality of pulses, each pulse being defined by a position and an amplitude, when the discrimination information from said mode discrimination section represents a specific mode, wherein a position of at least one pulse is determined from N possible position variations of said at least one pulse, N being set in advance to be greater than one, and wherein an amplitude value is set in advance for each of the N possible position variations of said at least one pulse and an amplitude of said at least one pulse is determined as the amplitude value corresponding to the determined position of said at least one pulse.

13. A speech coding apparatus as claimed in claim 12, wherein the amplitude value for each of the N possible position variations of the at least one pulse is trained using a plurality of speech signals.

14. A speech coding apparatus as claimed in claim 13, wherein the N possible positions variations of the at least one pulse is limited in advance.

15. A speech coding apparatus as claimed in claim 12, wherein the N possible positions variations of the at least one pulse is limited in advance.

16. A speech coding apparatus for calculating a spectral parameter from a speech signal inputted thereto, quantizing an excitation signal of the speech signal using the spectral parameter and outputting the quantized excitation signal, comprising:

a mode discrimination section for discriminating a mode from the speech signal inputted thereto and outputting discrimination information; and an excitation quantization section for quantizing the excitation signal using a plurality of pulses, each pulse being defined by a position and an amplitude, when the discrimination information from said mode discrimination section represents a specific mode, wherein a position of at least one pulse is determined from N possible position variations of the pulse, N being set in advance to be greater than one, and wherein an amplitude or polarity of the at least one pulse is quantized simultaneously with amplitudes and polarities of the remaining plurality of pulses.

17. A speech coding apparatus as claimed in claim 16, further comprising a codebook determined in advance using a plurality of speech signals, said excitation quantization section using said codebook to quantize the amplitudes or polarities of the plurality of pulses simultaneously.

18. A speech coding apparatus as claimed in claim 17, wherein the N possible positions variations of the at least one pulse is limited in advance.

19. A speech coding apparatus as claimed in claim 16, wherein the N possible positions variations of the at least one pulse is limited in advance.

20. A speech coding apparatus as claimed in claim 16 wherein the specific mode comprises one of a silent/consonant portion, a transition portion, a weak steady portion of a vowel, and a strong steady portion of a vowel.

* * * * *